US006669828B2

(12) United States Patent
Fritz-Langhals

(10) Patent No.: US 6,669,828 B2
(45) Date of Patent: Dec. 30, 2003

(54) CATHODE FOR ELECTROLYSIS CELLS

(75) Inventor: Elke Fritz-Langhals, Ottobrunn (DE)

(73) Assignee: Consortium für Elektrochemische Industrie GmbH, München (DE)

( * ) Notice: Subject to any disclaimer, the term of this patent is extended or adjusted under 35 U.S.C. 154(b) by 121 days.

(21) Appl. No.: 09/927,227

(22) Filed: Aug. 10, 2001

(65) Prior Publication Data

US 2002/0027083 A1 Mar. 7, 2002

(30) Foreign Application Priority Data

Aug. 10, 2000 (DE) ..... 100 39 171

(51) Int. Cl.[7] ..... C25B 11/04

(52) U.S. Cl. ..... 204/292; 204/293; 204/294; 204/290.01; 205/413; 205/443; 205/444

(58) Field of Search ..... 204/291, 292, 204/293, 294, 280, 290.01; 205/413, 443, 444

(56) References Cited

U.S. PATENT DOCUMENTS

| | | | | | |
|---|---|---|---|---|---|
| 2,422,468 | A | | 6/1947 | Chambers et al. | |
| 2,485,258 | A | | 10/1949 | Chambers et al. | |
| 2,925,371 | A | | 2/1960 | Van Wickel et al. | |
| 4,459,189 | A | * | 7/1984 | Vance et al. | 205/561 |
| 5,626,738 | A | * | 5/1997 | Richie | 205/444 |
| 5,919,349 | A | * | 7/1999 | Huber et al. | 205/413 |
| 6,159,352 | A | * | 12/2000 | Riera et al. | 204/530 |

FOREIGN PATENT DOCUMENTS

| | | |
|---|---|---|
| DE | 1024518 | 2/1958 |
| DE | 4319951 | 12/1994 |
| EP | 0931856 | 6/1994 |
| EP | 0905282 | 1/2000 |

OTHER PUBLICATIONS

English Derwent Abstract AN 1995–030922 [05] Corresp. to DE 43 19951.
Dechema Monogr. (1992), 125, 769–75 CAPLUS Abstract, AN: 1992: 600363.
Izv. Vyssh. Uchebr. Zaved, Tsvdr. Medall (1992), (5–6), 45–49, Abstract CAPLUS, AN:1994:147187.
CAPLUS Abstract AN: 1960:15458 of US 2,907,703 Corresp. to DE 1024518.
English Derwent Abstract AN 1995–030922 [05] Corresp. to EP 0931856 A2.
A. Aldaz et al. in Electrochemical Processing Technologies, 1997, Maimi, Florida.
T.R. Ralph et al., J. Electroanal. Chem. 1994, 375, 17.
C. Daobao in Jingxi Huagong 1998, 15 pp. 258 et Seq. and pp. 297 et Seq.
M. Li Gaixia, Fine Chemicals 1998, 15, p. 294.
D.G. Peters, H. Lund and, M.M. Baizer in Organic Electrochemistry, Published by Marcel Dekker, New York 1991, p. 362 et Seq.
I. Nishiguchi et al., Electroorg. Synth. 1991, p. 331.
"Industrial Electrochemistry" by Pletcher and Walsh, Chapman and Hall, London 1989 pp. 141–166 and pp. 313–319.
H. Lund in Organic Electrochemistry, Published by Marcel Dekker, New York 1991, p. 274.
English Derwent Abstract AN 1998–032213 [3] Corresp. to EP 905 282 B1.

* cited by examiner

*Primary Examiner*—Bruce F. Bell
(74) *Attorney, Agent, or Firm*—Collard & Roe, P.C.

(57) ABSTRACT

A cathode is made of an electrically conducting support with a coating of electrochemically deposited lead with a density between 0.001 and 2 g/cm$^3$.

8 Claims, No Drawings

CATHODE FOR ELECTROLYSIS CELLS

BACKGROUND OF THE INVENTION

1. Field of the Invention

The present invention relates to a cathode which is employed for the electrochemical reduction of organic compounds, to processes for the preparation thereof and to the use thereof for the electrochemical reduction of organic compounds.

2. The Prior Art

The electrochemical reduction of organic compounds is an important method for preparing a large number of products. The cathode frequently used in this case is lead, which is distinguished by a high hydrogen overvoltage.

Reductions are carried out on lead plates for example of disulfide compounds (A. Aldaz et al. in Electrochemical Processing Technologies, 1997, Miami, Fla.), to give the corresponding thiols. On the industrial scale, cysteine hydrochloride is obtained by reduction of cystine on lead cathodes (review: T. R. Ralph et al., J. Electroanal. Chem. 1994, 375, 17). High chemical yields are obtained in this case with current densities of up to 700 A/m$^2$. Due to the competing evolution of hydrogen, the current yields are limited to about 46%. Various authors describe progressive passivation of the lead surface in this reaction (C. Daobao in Jingxi Huagong 1998, 15, pp. 258 et seq. and pp. 297 et seq., M. Li ibid., p. 294) even at current densities of 200–500 A/m$^2$.

Further examples of the use of lead cathodes are the reduction of aldehydes, ketones, carboxylic acids and carboxylic esters to alcohols, the reduction of heterocycles and dehalogenations (review: M. M. Baizer in Organic Electrochemistry, published by Marcel Dekker, New York 1991, pp. 362 et seq., X. Nishiguchi et al., Electroorg. Synth. 1991, p. 331). Numerous processes are also carried out on an industrial scale with lead cathodes (review: "Industrial Electrochemistry" by Pletcher and Walsh, Chapman and Hall, London 1989, pp. 313–319).

Because of the low mechanical stability of lead associated with the high intrinsic weight and the difficulty of making contact, lead-plated support cathodes, for example made of copper or titanium, are preferred for industrial applications in which large electrode areas are required (M. M. Baizer in Organic Electrochemistry, published by Marcel Dekker, New York 1991, p. 274). However, appropriate coating processes are costly and complicated. Flat geometries are imperative in this case, so that the coating adheres well to the support. It is also known that lead surfaces are easily deactivated (EP 0 931 856), leading to a decrease in the current yields and the area-time outputs. Corrosion of lead electrodes has also been described. To regenerate the cathode surface it is necessary each time to dismantle the electrolysis cell completely. The resulting long nonproductive periods greatly restrict the commercial usefulness.

DE patent 1 024 518 discloses that cystine can be reduced to cysteine with a 100% current yield on tin cathodes with a current density of 500 A/m$^2$. Our own experiments show that the current yields fall below 30% on increasing the current densities up to 2000 A/m$^2$ on tin because, under these conditions, the evolution of hydrogen starts considerably earlier. In addition, the current yield decreases further in subsequent experiments.

SUMMARY OF THE INVENTION

It is an object of the present invention to provide a cathode which has a high hydrogen overvoltage, can easily be produced and regenerated, and is suitable for the reduction of organic compounds on the industrial scale.

The above object is achieved according to the present invention by a cathode comprising an electrically conducting support with a coating of electrochemically deposited lead with a density between 0.001 and 2 g/cm$^3$.

This lead coating or layer has a loose structure with a density which is greatly reduced compared with solid lead and is in the range of density between 0.001 and 2 g/cm$^3$, preferably between 0.01 and 1 g/cm$^3$. The increase in the surface area provided by the reduced density has an advantageous effect on the area-time output of the chemical processes.

The support or the cathode of the invention comprises an electrically conducting material, preferably a metal, excepting an alkali metal or alkaline earth metal, or a metal alloy or graphite.

The electrically conducting support particularly preferably comprises a metal or a metal alloy selected from the group consisting of copper, nickel, tin, zinc, titanium, iron, steel, stainless steel, cadmium and lead.

Elements which may also be present as constituents of the alloys are selected from the group consisting of tungsten, chromium, cobalt, molybdenum, manganese, bismuth, aluminium, mercury, zirconium, vanadium, silicon, boron, niobium, tantalum, antimony, phosphorus and carbon.

The term metal hereinafter also encompasses metal alloys as discussed above.

A support of this type can be coated with one or more metals mentioned above. Processes suitable for the coating are all those known to the person skilled in the art, such as, for example, electroplating or sputtering.

The shape of the electrically conducting support is not critical. It is preferably selected from the large number of known and available electrode geometries, for example plate, lattice, foam, disk, tube, perforated plate, rod etc.

The lead coating or layer deposited on the electrically conducting support is distinguished by having a density which is reduced compared with solid lead and is in the range from 0.001 to 2 g/cm$^2$, preferably between 0.01 and 1 g/cm$^3$.

The invention further relates to a process for producing a cathode of the invention.

The production of a cathode of the invention comprises depositing a lead layer of reduced density from a lead salt-containing aqueous catholyte solution by electrochemical deposition onto an electrically conducting support. This cathode is connected as a cathode, and used in an electrolysis cell known per se.

Any cell known to a person skilled in the art is suitable as an electrolysis cell. A selection of frequently used cells is to be found in text books, for example in "Industrial Electrochemistry" by Pletcher and Walsh, Chapman and Hall, London 1989, pp. 141–166.

Lead salts suitable for the lead salt-containing aqueous solution are all lead salts which contain lead in the divalent state, for example lead(II) carbonate, lead(II) chloride, lead (II) fluoride, lead(II) acetate, lead(II) formate, lead(II) oxalate, lead(II) nitrate and their basic salts, lead(II) sulfate and lead(II) oxide.

It is also possible to use a combination of metallic lead with an appropriate acid, from which a lead salt-containing solution is then formed.

A suitable solvent is water with the addition of mineral acids, preferably hydrochloric acid, sulfuric acid and phosphoric acid in a concentration between 0.5 M and 12 M, in the case of hydrochloric acid up to 8.5 M. Further possible additions are organic acids, for example acetic acid, formic acid, citric acid, lactic acid or their salts with ammonium, tetraalkylammonium, sodium or potassium ions, or complexing agents for divalent lead ions, for example EDTA or NTA in amounts of from 1 to 3 equivalents based on the amount of lead present.

The lead salt-containing solution may, where appropriate, additionally contain inorganic salts as conducting salts. Examples thereof are all alkali metal, alkaline earth metal and ammonium salts, for example sodium chloride, sodium sulfate, ammonium chloride, lithium perchlorate.

The lead salt-containing aqueous solution may additionally contain, where appropriate, water-miscible cosolvents such as ethanol, methanol, i-propanol, n-propanol, acetonitrile, ethylene glycol, ethylene glycol monomethyl ether, ethylene glycol monoethyl ether, tetrahydrofuran, 1,4-dioxane, methyl acetate, ethyl acetate, dimethylformamide, sulfolane, ethylene carbonate, N,N'-dimethylpropylene-urea, N,N'-dimethylethyleneurea, N-methylpyrrolidone, tetramethylurea and hexamethylphosphortriamide in concentrations of from 0.1 to 80% by weight, preferably 1 to 50% by weight.

The lead ion concentration in the lead salt-containing aqueous solution is preferably between 1 ppm and 20 g/l, particularly preferably between 10 ppm and 10 g/l.

The pH of the electrolysis solution is preferably between 1 and 6, particularly preferably between 1 and 3.

The deposition of the lead layer is preferably achieved by applying a cathode potential of between −0.1 V and the value at which evolution of hydrogen starts at the cathode. Current densities of from 0.1 A/m$^2$ to 4000 AR/m$^2$, preferably 10 to 3000 A/m$^2$, are set in this case.

The temperature when carrying out the process is not critical. It can be chosen freely in wide ranges. A lower temperature limit is set by the freezing point of the catholyte solution, and an upper limit is set by the stability of the electrolysis cell. In the case of membrane cells, this is in particular the thermal stability of the membrane. In this case, the maximum temperature is limited to 60° C.

The formation of the lead layer can also take place before or at the same time as the reduction of an organic compound.

The invention therefore also relates to a process for the electrochemical reduction of an organic compound, wherein, in place of a conventional cathode made of solid lead or a cathode with a solid lead coating, for example a lead film, there is the use of the cathode of the invention.

This process can be carried out analogously to known electrochemical processes for the reduction of such compounds using the cathode of the invention (review: M. M. Baizer in Organic Electrochemistry, published by Marcel Dekker, New York 1991, pp. 362 et seq.).

The compound to be reduced is preferably an organic sulfur compound, for example a disulfide compound, a sulfinic acid, a sulfoxide or a thioether, or an organic carbonyl compound, for example an aldehyde or ketone. Particularly preferred disulfide compounds are cystine, N-alkanoylcystine, homocystine and N-alkanoylhomocystine. The concentration of the compound to be reduced is from 0.01 M to 10 M, preferably 0.1 M to 5 M. The solvent preferably used is an aqueous solution of mineral acid, for example hydrochloric acid, sulfuric acid or phosphoric acid. Also the solvent preferably used is an aqueous solution of sodium or potassium hydroxide, sodium or potassium carbonate or acetate, ammonia, ammonium chloride or ammonium acetate in concentrations between 0.1 M and 12 M. The electrochemical reduction of the cystine and homocystine is preferably carried out in aqueous hydrochloric acid, sulfuric acid, sodium or potassium hydroxide solution or in ammoniacal solution. The concentration of cystine can be between 0.1 M and the saturation concentration. Saturated cystine or homocystine solutions are particularly preferred. The reduction of N-acetylcystine is preferably carried out at pH values between 5 and 13.

The electrolyses are carried out at temperatures between 0° C. and 70° C., preferably at temperatures between 10° C. and 50° C.

The current densities are 0.1 A/m$^2$ to 20,000 A/m$^2$, preferably 10 to 5000 A/m$^2$.

All divided cells known to the person skilled in the art can be used to reduce organic sulfur and oxygen compounds (review, for example, in "Industrial Electrochemistry" by Pletcher and Walsh, Chapman and Hall, London 1989, pp. 141–166).

It is possible with the cathode of the invention to produce cysteine hydrochloride from cystine in an electrolysis solution containing hydrochloric acid with the unusually high current density of 2000 A/m$^2$ and with an area-time output of 7.3 kg of cysteine hydrochloride hydrate per hour and m of membrane area (see equation 1 in scheme 1). This area-time output is constant on operation for a period of up to at least 5 days. No lead is detectable, with a detection limit of 0.5 ppm, in the electrolysis solution.

A comparative experiment using a conventional cathode made from solid lead gave, at 2000 A/m$^2$, an area-time output of only about 4 kg per hour and m$^2$ of membrane area. Particularly at conversions of over 90% in the case of the conventional lead cathode with the high current densities there is a pronounced slowing-down of the reaction because of the evolution of hydrogen prevailing. This is likewise to be observed during the use of the tin cathode described in DE 1 024 518 (see comparative examples 7 and 8).

It is also possible with the cathode of the invention very easily to carry cut other reductions such as, for example, the homolysis or activated C-S bonds, the reduction of sulfinic acids or the reduction of keto groups.

DETAILED DESCRIPTION OF PREFERRED EMBODIMENTS

Other objects and features of the present invention will become apparent from the following detailed description considered in connection with the accompanying examples which discloses several embodiments of the present invention. It should be understood, however, that the examples are designed for the purpose of illustration only and not as a definition of the limits of the invention.

The following schemes (scheme 1) illustrate further possible uses by way of example.

Scheme 1

(Eq. 1)

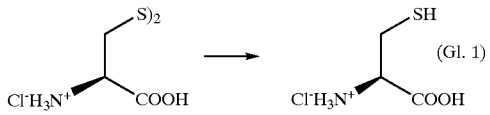

(Gl. 1)

-continued (Eq. 2)

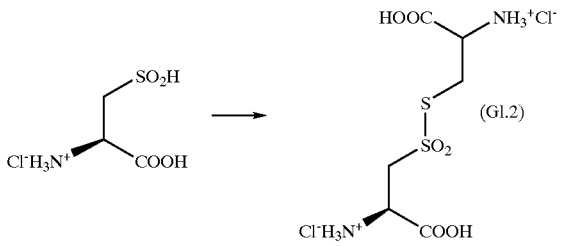

(Eq. 3)

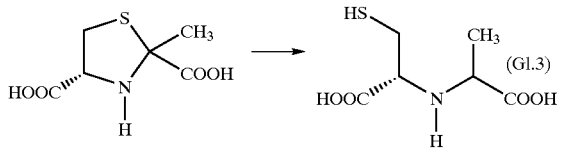

(Eq. 4)

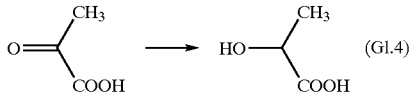

The reduction of cysteinesulfinic acid leads to the formation of cystine S,S-dioxide (equation 2).

The reduction of 2,4-dicarboxy-2-methylthiazolidine leads to the formation of N(1-carboxyethyl)cysteine (equation 3).

Pyruvic acid is quantitatively reduced to lactic acid (equation 4).

Another advantage of the cathode of the invention is that it can easily be regenerated. The regeneration is possible without dismantling the cell. The lead layer is in this case in one embodiment removed mechanically by flushing the catholyte chamber with water or with the catholyte liquid.

In another embodiment, the lead layer is partly or completely dissolved. Suitable for this purpose are aqueous solutions of mineral acids or organic acids in concentrations between 0.1 and 10 M, apart from sulfuric acid. Examples thereof are hydrochloric acid, phosphoric acid or acetic acid. It is possible where appropriate to add to the aqueous acid solution complexing agents to increase the solubility of the resulting lead salt in amounts between 0.5 and 5 equivalents based on the amount of lead to be dissolved. Complexing agents for lead(II) ions are, for example, EDTA, NTA and citric acid. The temperatures in this case are within the range for operating the electrochemical cell.

To protect the electrode from corrosion, a protective voltage is maintained during the removal of the lead layer.

The following examples illustrate the invention further.

EXAMPLE 1

Production of a Cathode of the Invention

Cell used; A cell which is divided by means of a membrane of Nafion 324 (electrode and membrane area 0.01 $m^2$) and have electrodes which are arranged plane-parallel and consist of a copper cathode, an oxygen-evolving DSA anode (supplied by DeNora Deutschland GmbH, anolyte: 20 percent sulfuric acid). The electrode-membrane distance was 1.8 cm. Catholyte and anolyte solutions were pumped through the cell from reservoirs (batch-recycle operation). Lead was deposited on the cathode in a loose structure by circulating the catholyte, consisting of a solution of 2.00 g of basic lead carbonate in 1.8 l of 1N HCl, by pump at flow rates of 1–2/h and a current I of 5 A. After a reaction time of 5 h, the residual lead content in the solution was 21.8 ppm.

EXAMPLE 2

Production of a Cathode of the Invention

Electrolytic deposition of lead onto the copper cathode took place from a solution of 2.00 g of basic lead carbonate in a solution of 360 g of cystine and 367 g of concentrated HCl in 1314 g of water at 6.9 A in analogy to Example 1.

Reaction time: 15 h.

Residual lead content in the solution <0.5 ppm.

Conversion of cystine to cysteine hydrochloride: 99.7% (measured by HPLC and optical rotation $\alpha$).

EXAMPLE 3

Reduction of Cystine to Cysteine Hydrochloride

In the electrolysis apparatus of Example 1 in using the cathode prepared as in Example 1, 1.00 kg of cystine in 3.65 l of water and 1019 g of concentrated HCl were converted into cysteine hydrochloride at a current density of 2000 $A/m^2$ and circulation rates of 10–12/h by pump. After 11 h, 90% of the cystine were converted into cysteine hydrochloride. The conversion was complete after 20 h. (Degree of conversion >99.7%, determined by HPLC). Chemical yield >99.9%; (investigation of the mother liquor obtained after multiple crystallization). Calculated area-time output was 7.31 kg of cysteine hydrochloride monohydrate per hour and $m^2$ of membrane area.

EXAMPLE 4

Reduction of Cystine to Cysteine Hydrochloride

A loose lead layer was deposited in an 0.01 $m^2$ ElectroMPCell (supplied by ElectroCell AB, Taby, Sweden) with a tinned copper cathode, DSA anode (supplied by Parmascand, Sweden) and Nafion 324 cation exchange membrane as described in Example 2 (circulation rate 1–2/h by pump). Then, in analogy to Example 3, 4.0 kg of cystine were converted at 2000 $A/m^2$ into cysteine hydrochloride (circulation rate 12/h by pump). The reaction took 79 hours. Calculated area-time output was 7.41 kg of cysteine hydrochloride monohydrate per $m^2$ of membrane area and per hour.

EXAMPLE 5

Reduction of Cystine to Cysteine Hydrochloride

A loose lead layer was deposited in an 0.01 $m^2$ in ElectroMPCell (supplied by ElectroCell AB, Taby, Sweden) with a nickel cathode, oxygen-evolving DSA anode (supplied by Parmascand, Sweden) and Nafion 324 cation exchange membrane as described in Example 2 (circulation rate 1–2/h by pump). Then, in analogy to Example 4, 360 g of cystine were converted into cysteine hydrochloride. The conversion was complete after a reaction time of 7.0 h. (Degree of conversion >99.7% determined by HPLC). Calculated area-time output was 7.52 kg of cysteine hydrochloride monohydrate per $m^2$ of membrane area and per hour.

EXAMPLE 6

Reduction of Cystine to Cysteine Hydrochloride

Lead was loosely deposited on a lead cathode from 750 mg of dissolved white lead in analogy to Example 1. 1.00 kg of cystine was reduced to cysteine hydrochloride as in Example 3. Total reaction time: 21.8 hours. Calculated area-tine output was 6.71 kg of cysteine hydrochloride monohydrate per $m^2$ of membrane area and per hour.

EXAMPLE 7

Reduction of Cystine to Cysteine Hydrochloride—Comparative Example 360 g of cystine were reduced to cysteine hydrochloride as in Example 3 in an electrolysis cell with a lead plate as cathode. Total reaction time 9.4 hours. Calculated area-time output was 4 kg of cysteine hydrochloride monohydrate per $m^2$ of membrane area and per hour.

EXAMPLE 8

Reduction of Cystine to Cysteine Hydrochloride—Comparative Example to Example 3

A catholyte solution composed of 360 g of cystine, 3.00 g of tin(II) chloride dehydrate was reacted in an electrolysis apparatus as in example 4 with a tinned copper plate as cathode at a flow rate of 1–2/h and a current I of 5 A. After a reaction time of 22 h, the conversion to cysteine was 98.1% (HPLC analysis). The tin content of the solution after this time was still about 0.7 ppm (equivalent to about 0.6 mg).

The catholyte solution was discharged from the cell and reservoir and replaced by a solution of 1.00 kg of cystine, 1019 g of concentrated HCl and 3651 g of water. This was reacted at a current strength of 20 A and a flow rate of 11/h. After a reaction time of 15.2 hours, 90% cystine had been converted. After 24 h, the solution still contained 2.7% cystine.

EXAMPLE 9

Reduction of Cysteinesulfinic Acid to Cystine S,S-Dioxide (Eq. 2)

In an electrolysis apparatus consisting of an electrolysis cell with disk-shaped electrodes (anode: DSA expanded titanium metal, cathode: perforated lead plate with loosely deposited lead, electrodes used on both sides and each welded on rods concentrically, diameter 7.5 cm) and of the peripherals constructed as in Example 1, a solution of 1.523 g of L-cysteinesulfinic acid monohydrate in 600 ml of 2N hydrochloric acid was reduced at 10 A and a reaction temperature of 15° C. for 4.5 h. The reaction solution contained 60% cystine S,S-dioxide, 20% cystinesulfinic acid and 20% cystine ($^1$H-NMR analysis).

EXAMPLE 10

Reduction of 2,4-dicarboxy-2-methylthiazolidine to N-(1-carboxyethyl)cysteine (Eq. 3)

In the electrolysis apparatus of Example 10, a solution of 130.0 g of 2,4-dicarboxy-2-methylthiazolidine in a mixture of 526 ml of water and 144 g of hydrochloric acid was reduced at 9.5 A and temperatures of 16–20° C. After a reaction time of 5 hours, 66% N-(1-carboxyethyl)cysteine, 19% lactic acid and 15% cysteine were obtained. The reaction solution was evaporated, and the solid was recrystallized from 0.5 m hydrochloric acid with exclusion of oxygen. N-(1-Carboxyethyl)cysteine was obtained in colorless crystals.

Accordingly, while a few embodiments of the present invention have been shown and described, it is to be understood that many changes and modifications may be made thereunto without departing from the spirit and scope of the invention as defined in the appended claims.

What is claimed is:

1. A cathode comprising an electrically conducting support with a coating of electrochemically deposited lead with a density between 0.001 and 2 g/$cm^3$.

2. The cathode as claimed in claim 1, wherein the support comprises a metal, excepting an alkali metal or alkaline earth metal, or a metal alloy or graphite.

3. The cathode as claimed in claim 1, wherein the electrically conducting support comprises a metal or a metal alloy selected from the group consisting of copper, nickel, tin, zinc, titanium, iron, steel, stainless steel, cadmium and lead.

4. The cathode as claimed in claim 3, wherein the metal alloy additionally comprises elements selected from the group consisting of tungsten, chromium, cobalt, molybdenum, manganese, bismuth, aluminium, mercury, zirconium, vanadium, silicon, boron, niobium, tantalum, antimony, phosphorus and carbon.

5. In a method for the electrochemical reduction of an organic compound, the improvement which comprises utilizing a cathode as claimed in claim 1 for said reduction.

6. The method as claimed in claim 5, wherein the organic compound is selected from the group consisting of an organic sulfur compound and an organic carbonyl compound.

7. The method as claimed in claim 6, wherein the sulfur compound is a disulfide compound.

8. The method as claimed in claim 7, wherein the disulfide compound is selected from the group consisting of cystine, N-alkanoylcystine, homocystine and N-alkanoylhomocystine.

* * * * *